United States Patent [19]

Barker

[11] 4,123,176

[45] Oct. 31, 1978

[54] PHOTOGRAPHIC DEVELOPER TURNING SYSTEM

[76] Inventor: Raymond H. Barker, 181 Cedarcrest La., Lewisville, Tex. 75067

[21] Appl. No.: 844,320

[22] Filed: Oct. 21, 1977

[51] Int. Cl.[2] ..... B01F 9/00

[52] U.S. Cl. ..... 366/166; 354/327; 366/230

[58] Field of Search ..... 366/208, 213, 219, 220, 366/230; 354/306, 314, 316, 323, 327, 330

[56] References Cited

U.S. PATENT DOCUMENTS

| | | | |
|---|---|---|---|
| 1,788,901 | 1/1931 | Wilson | 366/213 |
| 2,142,881 | 1/1939 | Bell | 354/330 |
| 2,349,026 | 5/1944 | Wildman | 354/327 |
| 3,173,352 | 3/1965 | Lane | 354/330 |
| 3,682,080 | 8/1972 | Merz | 354/327 X |
| 3,693,529 | 9/1972 | Stabler | 354/306 |
| 3,735,961 | 5/1973 | Taylor | 354/330 X |
| 3,792,487 | 2/1974 | Peres | 354/323 |
| 3,804,379 | 4/1974 | Merz | 366/166 |
| 3,981,488 | 9/1976 | Ratowsky | 366/219 |

*Primary Examiner*—Leonard D. Christian
*Attorney, Agent, or Firm*—Richards, Harris & Medlock

[57] ABSTRACT

A photographic developer turning system for periodically turning a film processing container. An electric motor connected to an output shaft is mechanically coupled to a clamp disposed about a cylindrically shaped film processing container. The motor turns the container about an axis perpendicular to the axis of the container. A cam, mounted on the shaft, opens a microswitch to interrupt the supply of power to the motor, after one rotation. A variable time delay switch connected to the microswitch permits the motor to be energized after a preselected time. After each rotation, the microswitch resets the time delay switch to zero so that the container may again be rotated after a preselected time delay.

10 Claims, 5 Drawing Figures

PHOTOGRAPHIC DEVELOPER TURNING SYSTEM

BACKGROUND OF THE INVENTION

1. Field of the Invention

The present invention relates to photographic accessories and more particularly to accessories for turning film processing containers.

2. Description of the Prior Art

In photography, photographic film is often processed by placing exposed film in special containers with developing or fixing agents and agitating the solutions from time to time to enhance the reduction of the light-exposed silver halide grains on the film. In many applications, especially in noncommercial processing, or in applications which require hand processing, photographic film is threaded onto wire racks so that the entire film surface is exposed to the chemical agent without contact with any other part of the film. In such applications, for example, developing agents are introduced into the container and at intervals ranging from 30 seconds to several minutes, depending upon the process, the container is inverted or agitated to redistribute the chemical solution within the container. The present invention is designed to enhance the processing of film in these applications by providing an electromechanical apparatus for periodically flipping a film processing container about an axis perpendicular to the axis of the container.

Film developing devices are known which impart motion to film processing containers to mix or redistribute the chemical agents therein. U.S. Pat. Nos. 3,682,080 and 3,804,379, issued to Merz, for example, disclose such devices. The devices disclosed in these patents illustrate a film processing apparatus which imparts a combined rotary and rocking motion to the film processing container. Such devices, however, do not teach a mechanical means for flipping a developing container about an axis perpendicular to the axis of the container, which provides greater agitation for the developing and fixing processes than rotation about the axis of the container.

Other devices, such as manually powered mixers, disclosed in U.S. Pat. Nos. 1,788,901 to Wilson; 1,917,119 to Holmquist; and 2,110,970 to Cravaritis, rotate containers about an axis perpendicular to the axis of rotation. None of these references, however, suggest applications to film processing, and, moreover, none use a time delay electromechanical apparatus for automatically flipping the film processing container.

Accordingly, a need arises for a device for electromechanically flipping a film processing container about an axis perpendicular to the axis of the container at periodic intervals.

SUMMARY OF THE INVENTION

The present invention is directed to an apparatus for periodically flipping a film processing container about an axis substantially perpendicular to the axis of the container.

In accordance with the present invention, an electric motor is mechanically coupled to a clamping means, which is dimensioned to retain a film processing container. The motor turns the container about an axis substantially perpendicular to the axis of the container. A switching means is mechanically opened by the clamping means to interrupt the supply of power to the motor after a complete rotation of the container. A time delay switch, connected to the switching means, permits the motor to be energized after a preselected time delay.

DESCRIPTION OF THE DRAWINGS

For a more complete understanding of the present invention and for further objects and advantages thereof, reference is now made to the following description taken in conjunction with the accompanying drawings in which.

DESCRIPTION OF THE PREFERRED EMBODIMENT

Figure 1:
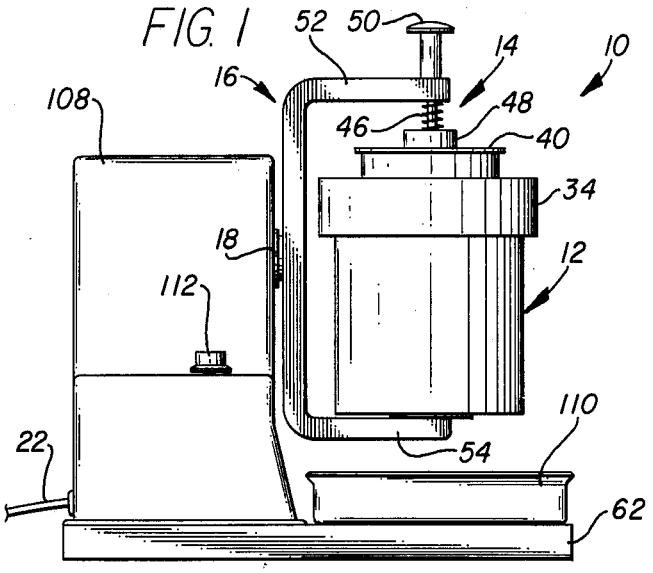
FIG. 1 is a side elevational of the present invention.

Referring generally to the drawings, there is shown a photographic developer turning system designated generally by the numeral 10. The film processing container 12 is shown retained by a clamp 14 which is mounted to a fixture 16. Fixture 16 is mechanically coupled to an output shaft 18, connected to an electric motor 20, which is energized by an ac source 22 by means of electrical circuitry 24 containing two switches: a variable time delay switch 26 and a single pole, double throw microswitch 28.

Figure 2:
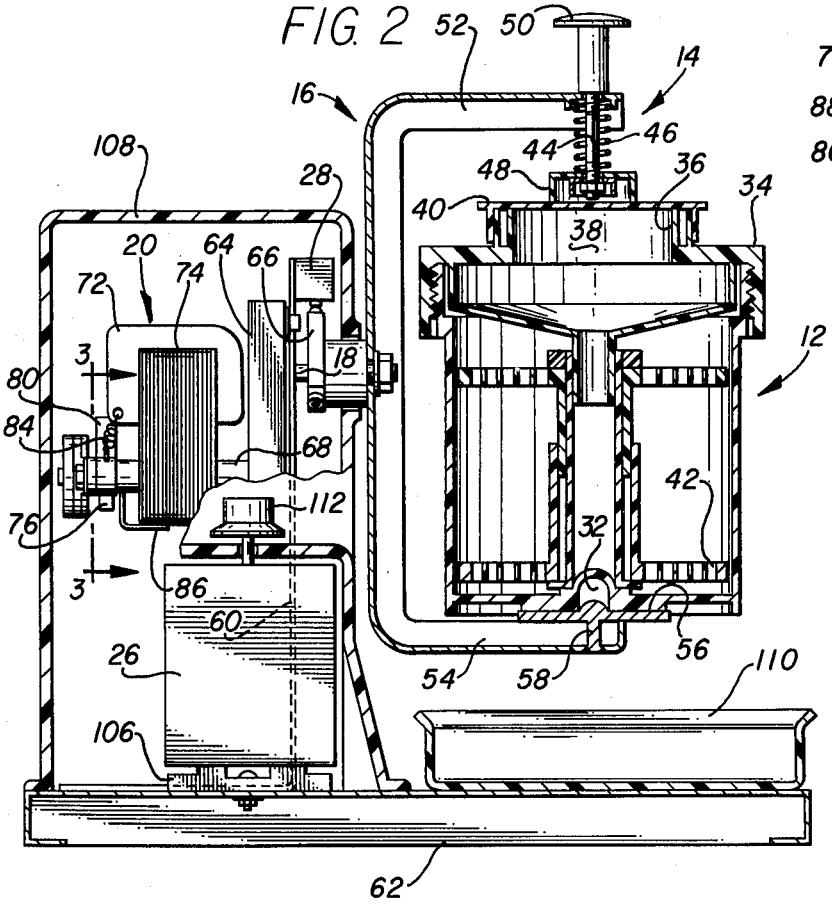
FIG. 2 is an elevational view partially in section.

Referring now to FIGS. 1 and 2, system 10 is designed for use with a film processing container 12 of the type commercially available in photographic supply stores, such as, for example, the Patterson TANK SYSTEM 4. Such containers are generally of cylindrical construction and have a closed bottom 30 which may have a closed, cylindrical well 32 defined therein. The opposite end of such containers are open and threaded at the open end and are dimensioned to be covered by a threaded cap 34. Developing agents, bleach, fixer or other chemicals may be introduced into the container through a narrow neck 36, which extends from the top surface of cap 34 to define an aperture 38, through which access is gained to the container. During operation of system 10, neck 36 is tightly capped by a cover 40 to prevent leakage of the chemical agents in the container.

Referring particularly to FIG. 2, container 12 contains a rackform 42, which is formed of two parallel helicoid racks placed in spaced apart relation by an axle designed for a roll of exposed film to be wound thereon so that the exposed surface of the film cannot contact any other part of the film. Occasional agitation and redistribution of liquid chemical agents in the container enhances the reactions of these agents with the surface of the film. The present invention is adapted to promote such reactions by periodically flipping the container about an axis perpendicular to the axis of the container.

As shown in FIGS. 1 and 2, container 12 is retained in fixture 16 by means of a clamp 14, which is mounted on and extends through the fixture. Clamp 14 employs a rod 44 which extends through fixture 16 and is biased towards container 12 along the axis of the container by a compressive spring 46. Rod 44 terminates in a disk contact surface 48 which is forced against cover 40 of the container when the container is placed within the fixture. The opposite end of rod 44 terminates in a knob 50, by which clamp 14 may be released. As knob 50 is pulled up to move contact surface 48 toward fixture 16, clamp 14 releases the container or provides clearance for a container to be placed within the fixture.

As best shown in FIGS. 1 and 2, fixture 16 is a lightweight metal frame of C-shaped configuration. The upper leg 52 of the fixture contains the spring biased clamp 14 discussed above. The lower leg 54 defines a second disk contact surface 56, which makes contact with the bottom 30 of the container at a point likewise on the axis of the container. Contact surface 56 is riveted to lower leg 54 by means of a rivet 58, the head of which is disposed within the well 32 to retain container 12 in the fixture. Fixture 16 is bolted to the output shaft 18, midway between upper and lower legs 52 and 54.

Fixture 16 is supported by means of a supporting structure 60 which is perpendicularly mounted to the base 62 of the system, at a height for fixture 16 to be clear of base 62 regardless of its position. The fixture is supported in structure 60 by output shaft 18, which passes through the supporting structure into gearbox 64 mounted on the opposite side thereof. A cam 66 is rigidly mounted to shaft 18 between fixture 16 and supporting structure 60. Cam 66 has an eccentric surface which engages microswitch 28 to mechanically open the circuitry 24 in a manner described in greater detail below.

A motor shaft 68 of electric motor 20 is input into gearbox 64. Gearbox 64 contains a suitable arrangement of gears (not shown) so that output shaft 18 is rotated at a rate of about 50 RPM.

In the preferred embodiment, electric motor 20 is a conventional 115 volt, 60 Hz ac motor, although other applications may dictate the use of a dc motor where a dc source is provided. Motor 20 contains a motor winding 72, which is disposed about a metal core 74. When motor 20 is energized, core 74 acts as an electromagnet which can be used to activate the braking system.

Figure 3:
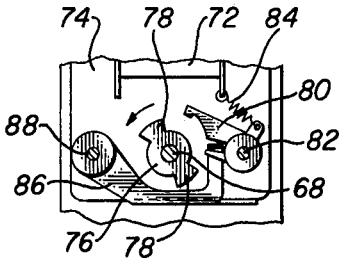
FIG. 3 is a section view of the present invention taken along the line 3—3 in FIG. 2 showing the braking mechanism of the present invention.
Figure 4:
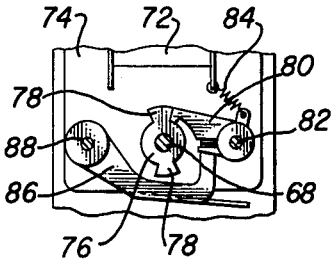
FIG. 4 is likewise a section view taken along the line 3—3 in FIG. 3, showing the operation of the braking system.

FIGS. 3 and 4 illustrate the braking system of the present invention. The opposite end of motor shaft 68 is shown having a drum 76 mounted thereon. Drum 76 is a cylindrically shaped fitting having two lugs 78 extending therefrom, dimensioned to engage shoe 80. As evident from FIGS. 3 and 4, shoe 80 is pivoted at one end about a pin 82 and is normally biased by means of spring 84 to engage one of lugs 78. The underside of shoe 80 engages a release armature 86, which is pivoted from a second pin 88. As armature 86 is pivoted about pin 88, its upward movement forces shoe 80 to likewise pivot about pin 82. When motor 20 is energized, the resultant electromagnetic activity in core 74 causes armature 86 to pivot about pin 82 and make contact therewith, causing shoe 80 to pivot so that drum 76 rotates freely, clear of the shoe. When the power supplied to motor 20 is interrupted by cam 66, after nearly one complete rotation, armature 86 pivots back to its normal position so that shoe 80 then engages one of the lugs 78 as shown in FIG. 4, to bring fixture 16 to a relatively quick stop. The braking system described herein prevents fixture 16 from overshooting its vertical position which happens if the fixture is allowed to come to rest by friction.

Figure 5:
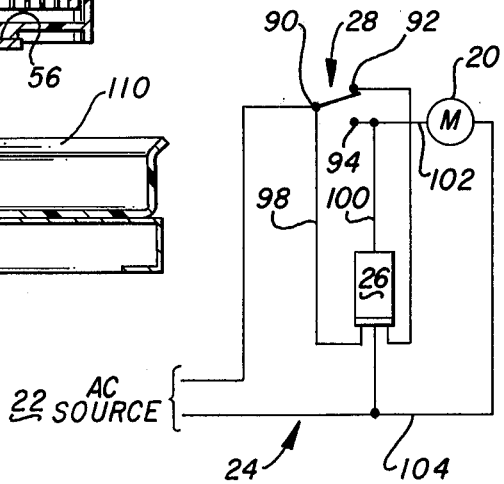
FIG. 5 is a schematic block diagram of the circuit for the present invention.

Referring now to FIG. 5, an arc source 22 supplies power to an ac motor 20 through a variable time delay switch 26 and through a single pole, double throw microswitch 28 having an input terminal 90 and two output terminals 92 and 94. When not in contact with cam 66, microswitch 28 is in its "normal" position, in which contact is made across input terminal 90 and output terminal 92, so that a voltage is applied across switch 28 and variable time delay switch 26 by reset conductor 96. At some preselected time the voltage level in time delay switch 26 reaches a threshold voltage, at which time switch 26 is closed and the circuit between conductors 98 and 100 is completed to supply power to motor 20. When the eccentric portion of cam 66 mechanically contacts microswitch 28, just before fixture 16 has made a complete rotation, contact between terminals 90 and 92 is broken and contact is briefly established between input terminal 90 and output terminal 94. Motor 20 is briefly energized by power supplied through microswitch 28 across terminals 90 and 94 via conductor 102. When contact is broken between terminals 90 and 92 in microswitch 28, the voltage in reset conductor 96 drops briefly to zero. The zero voltage in conductor 96 causes time delay switch 26 to be reset to zero thereby discharging the capacitor. As cam 66 passes beyond switch 28, the switch again resumes its "normal" position, in which it is again closed across terminals 90 and 92. As power is no longer supplied to motor 20 across terminals 90 and 94, and as it is no longer supplied through conductors 98 and 100, when time delay switch 26 is open, motor 20 is not again energized until after some predetermined time, when switch 26 is again closed.

Variable time delay switch 26 contains an RC circuit connected to a normally open relay switch, which closes after a predetermined time, when the voltage reaches a required threshold level, to complete the circuit between conductor 98 and conductor 100. When the voltage across switches 26 and 28 goes to zero caused by the contact of cam 66 with microswitch 28, a spring-actuated relay in switch 26 causes the capacitor in the internal RC circuit to discharge thus resetting the timer. Time delay switching of the type contemplated in the present invention is commercially available, as for example, from Potter and Bromfield Company. In such time delay switches, the time constant in the internal RC circuit may be varied by changing the resistance in the circuit by a potentiometer. When the preselected time has passed, the voltage in the internal RC circuit becomes sufficiently high to close the relay switch between conductors 98 and 100, thereby supplying power to motor 20. As shown in the schematic, common conductor 104 completes the circuit between time delay switch 26 and ground. Commercially available switch 26 is removably mounted in an octal plug 106 mounted on base 62 of the system, as shown in FIG. 2.

The motor works and circuitry of the system may be insulated from contact with chemical agents by means of a waterproof casing 108. A shallow tray 110 may be placed directly beneath fixture 16 to catch any spillage of chemical agents from container 12 as it is flipped.

An adjustment knob 112 extends through casing 108 and is connected to variable time delay switch 26. Knob 112 is connected directly to the potentiometer in the internal RC circuit of switch 26 so that the operator can set the time delay anywhere in a given time range. In ordinary applications, the container will require flipping about once every 30 seconds. In developing black and white film, the film will be in the container for approximately 4 minutes and will be agitated every 30 seconds. In the case of color film, the film will be immersed in the developing agent for approximately 18 minutes, and in the bleach for approximately 9 minutes.

The film processing container will be turned approximately every 30 seconds, or more or less frequently, as desired.

Although particular embodiments of the invention have been described herein, it will be understood that the invention is not limited to the embodiments disclosed, but is capable of rearrangement, modificaton and substitution of parts and elements without departing from the spirit and scope of the invention.

What is claimed is:

1. An apparatus connected to a power source for periodically flipping a film processing container, comprising:

a clamping means disposed about the container for rotating it about an axis substantially perpendicular to the axis of the container;

an electric motor mechanically coupled to said clamping means, adapted to rotate said clamping means about an axis substantially perpendicular to the axis of the container;

switching means adapted to be mechanically opened by said clamping means for interrupting the power supplied to said motor after one rotation of said container; and a time delay switch connected to said switching means, capable of energizing said motor after a preselected time.

2. The apparatus as defined in claim 1 further comprising means for resetting said time delay switch after one rotation of said container.

3. The apparatus as defined in claim 1 where said time delay switch is a variable time delay switch.

4. The apparatus as defined in claim 1 further comprising:

a braking means for braking the rotation of said clamping means when said switching means has been mechanically opened.

5. A photographic developer turning system connected to a power source, comprising:

a cylindrical film processing container dimensioned to retain exposed photographic film therein for processing;

a clamping means disposed about said container, adapted to rotate said container about an axis substantially perpendicular to the axis of said container;

an electric motor having a shaft, said shaft mechanically coupled to said clamping means and adapted to rotate said means about an axis substantially perpendicular to the axis of said container;

a cam mounted on said clamping means adapted to rotate therewith;

a mechanical switch capable of being opened by said cam for interrupting the supply of power to said motor after one rotation of said cam;

a time delay switch connected to said mechanical switch, capable of energizing said motor after a preselected time;

means for resetting said time delay switch to zero after said mechanical switch is opened by said cam;

braking means for smoothly braking the rotation of said motor when said cam opens said mechanical switch; and means for disengaging said braking means from said motor when said motor is energized.

6. The system as defined in claim 5 wherein said motor is an ac motor and said system is connected to an ac power source.

7. The system as defined in claim 5 wherein said means for resetting said time delay switch to zero includes a single pole, double throw switch connected to said time delay switch.

8. The system as defined in claim 5 wherein said means for disengaging said braking means includes an electromagnetic means which is energized when said motor is energized.

9. The photographic rotation system defined in claim 5 wherein said braking means includes a drum disposed along said shaft and a shoe capable of engaging said drum to prevent rotation of said shaft.

10. A photographic developer turning system connected to a power source, comprising:

a liquidtight cylindrical film processing container adapted to retain exposed photographic film in a chemical solution for processing;

a clamping means applied to said container along the axis thereof, said clamping means adapted to rotate said container about an axis substantially perpendicular to the axis of said container;

an ac electric motor having a shaft mechanically coupled to said clamping means and adapted to rotate said clamping means about an axis substantially perpendicular to the axis of said container;

a cam mounted to said clamping means, and adapted to rotate therewith;

a single pole, double throw switch adapted to be actuated by said cam to interrupt the supply of power to said motor after one rotation of said cam;

a variable time delay switch connected to said single pole, double throw switch, capable of permitting said motor to be energized after a preselected time;

said single pole, double throw switch adapted to reset said time delay switch to zero when said switch is actuated by said cam;

a braking means for smoothly braking the rotation of said shaft when said cam has completed one rotation;

an electromagnetic means for disengaging said braking means when said motor is energized; and a source of alternating current supplying power to said single pole, double throw switch and to said variable time delay switch.

* * * * *

UNITED STATES PATENT AND TRADEMARK OFFICE

CERTIFICATE OF CORRECTION

PATENT NO. : 4,123,176

DATED : October 31, 1978

INVENTOR(S) : RAYMOND H. BARKER

It is certified that error appears in the above-identified patent and that said Letters Patent are hereby corrected as shown below:

Column 3, line 65, change "arc" to --ac--.
Column 6, line 22, after "photographic" insert --developer--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*